US005390721A

United States Patent [19]

Oskam et al.

[11] Patent Number: 5,390,721

[45] Date of Patent: Feb. 21, 1995

[54] OPERATING MECHANISM FOR A BLIND OR SHIELDING DEVICE

[75] Inventors: Herman Oskam, AK Vlist; Dirk A. Ploeg, Papendrecht, both of Netherlands

[73] Assignee: Hunter Douglas International N.V., Willemstad, Netherlands

[21] Appl. No.: 731,782

[22] Filed: Jul. 18, 1991

[30] Foreign Application Priority Data

Jul. 18, 1990 [GB] United Kingdom ..... 9015828

[51] Int. Cl.[6] ..... E06B 9/36

[52] U.S. Cl. ..... 160/168.1; 160/176.1; 160/178.1; 160/900; 192/89.21

[58] Field of Search ..... 160/168.1, 173, 176.1, 160/177, 178.1, 900; 192/89 CR; 59/2, 78

[56] References Cited

U.S. PATENT DOCUMENTS

| | | | |
|---|---|---|---|
| 443,769 | 12/1890 | Hurford | 59/78 |
| 1,119,572 | 12/1914 | Butler | 59/78 |
| 1,193,008 | 8/1916 | Fuller | 192/89 CR X |
| 3,455,364 | 7/1969 | Fukuoka . | |
| 3,789,905 | 2/1974 | Saito . | |
| 4,047,554 | 9/1977 | Bullat | 160/900 X |
| 4,224,973 | 9/1980 | Hugin | 160/178.1 |
| 4,552,195 | 11/1985 | Dürig et al. | 160/900 X |
| 4,557,159 | 12/1985 | Gross . | |

FOREIGN PATENT DOCUMENTS

| | | |
|---|---|---|
| 2223610 | 11/1973 | Germany . |
| 1415747 | 11/1975 | United Kingdom . |
| 1476872 | 6/1977 | United Kingdom . |
| 1529993 | 10/1978 | United Kingdom . |
| 1547491 | 6/1979 | United Kingdom . |

*Primary Examiner*—David A. Scherbel
*Assistant Examiner*—Derek J. Berger
*Attorney, Agent, or Firm*—Gary M. Polumbus

[57] ABSTRACT

An operating mechanism for a blind or shielding device having angularly adjustable and retractable slats 12, said mechanism comprising a first driven element 27 for pivotally adjusting the angular orientation of the slats and a second driven element 30 for transversely moving the slats towards and away from the retracted position, a common actuating member 22 for driving said first and second driven elements, a coupling device 24 directly coupling said first driven element to said common actuating member, a final engagement and lost motion mechanism 28, 30 for releasibly engaging said common actuating member to said second driven element and allowing entraining of said second driven element after a predetermined number of revolutions of said actuating member neither of two different rotational senses, the final engagement associated with said lost motion mechanism in each rotational sense inducing a reactive force in an axial direction, said reactive force assisting in declutching of said coupling device.

19 Claims, 3 Drawing Sheets

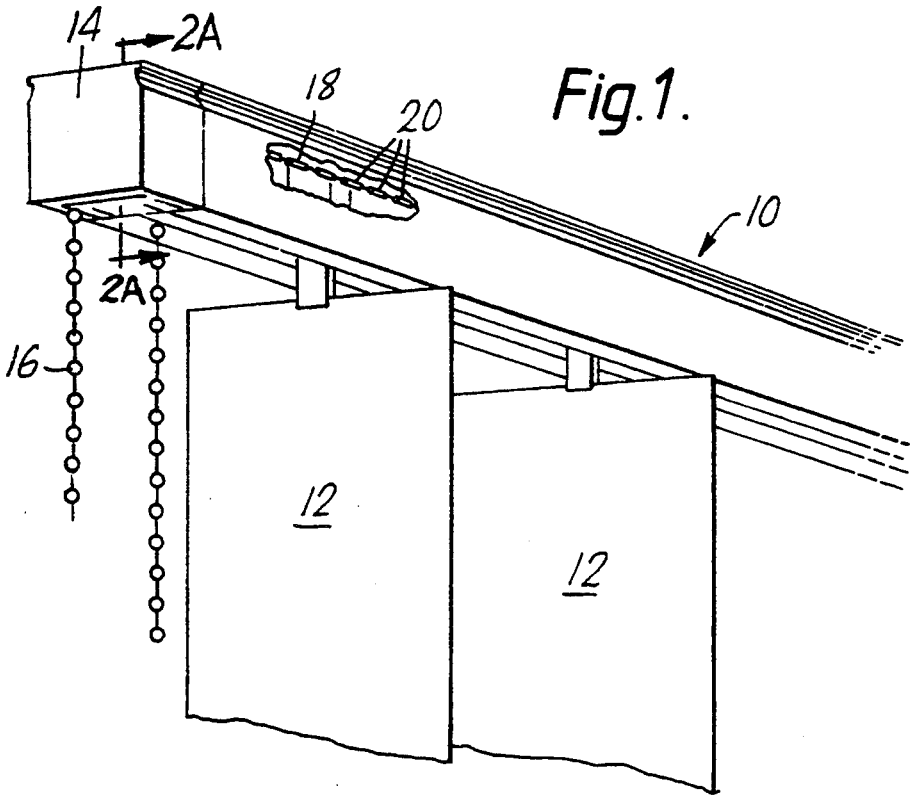
Fig. 1.
Fig. 7.
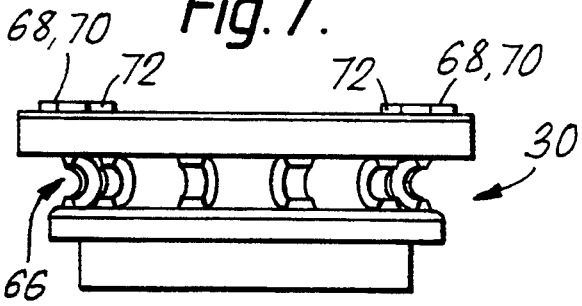
Fig. 9.
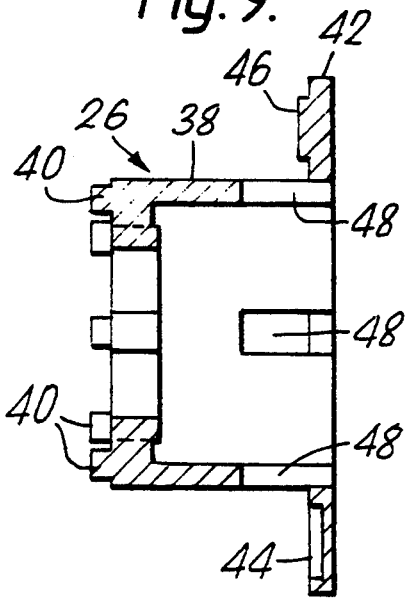
Fig. 8.
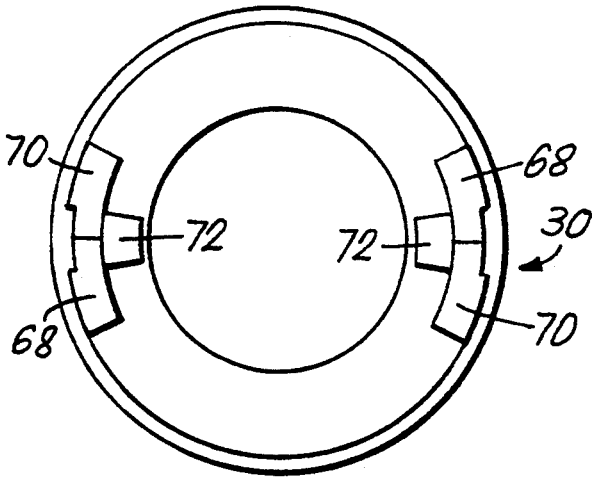

14
22
26
30
32
27
34

14
22
36
26
28
29
24
30
18
32
50
27
52
34
54
18
56
12
10

OPERATING MECHANISM FOR A BLIND OR SHIELDING DEVICE

The present invention relates to an operating mechanism for a blind or shielding device having angularly adjustable and retractable slats. An example of such a blind or shielding device is a vertical louvre blind.

It is known to have a single operating mechanism which is capable of carrying out both the adjustment of the angular orientation of the slats and the translational movement of the slats. One known form of such mechanism, for example as shown in GB-A-1547491 and 1529993 comprises a first driven element for pivotally adjusting the angular orientation of the slats and a second driven element for transversely moving the slats towards and away from a retracted position, a common actuating member sequentially driving said first and second driven element, a coupling device directly coupling the first and second driven elements to the common actuating member and a final engagement and lost motion mechanism for releasibly engaging the common actuating member to the second driven element and allowing entraining of the second driven element after a predetermined number of revolutions of the actuating member in either of two different rotational senses.

While such arrangements are generally satisfactory, they are rather cumbersome and expensive.

It is now proposed, according to the present invention, for the final engagement associated with said lost motion connection in each rotational sense to induce a reactive force in a direction perpendicular thereto, said reactive force assisting in the declutching of the coupling device.

By having this relatively simple method of actuating the declutching device, a more compact, less expensive and more reliable arrangement can be provided.

The transmission of power from the actuation member to the first driven element may, for example, be by means of a dog clutch or similar.

Preferably the amount of torque required to disengage the coupling device does not exceed the torque required for driving the second driven element. This ensures complete declutching of the coupling device before the translational transverse movement of the slats can take place.

Various forms of lost motion connection are contemplated, but in the preferred construction it comprises a plurality of discs each having a first projection extending from one axial face thereof and a second projection extending from the opposite axial face thereof, said projections being adapted to entrain the next adjacent disc after a predetermined amount of rotation between said adjacent discs.

Advantageously, the final engagement of the lost motion mechanism comprises an inclined surface on at least one of said discs, inducing the reactive force in the axial direction of said coupling device and allowing said movement by an amount sufficient to declutch the coupling device.

Desirably the rotational displacement permitted between the final engagement of the lost motion connection and the second driven element upon engagement of said inclined surface is restricted by a positive stop.

This positive stop is preferably at a different radial location of the final disc from the inclined surface thereof thereby enabling one to produce a more compact arrangement than if the positive stop were at the same radial location, thereby reducing the total bulk of the mechanism.

Advantageously the coupling device is biased towards axial engagement by means of a compression spring which is acted against during the declutching step caused by the reactive force referred to above.

The coupling device may be driveably and axially slidably engaged on the actuating member by means of cooperating keys and keyways on the actuating member and said coupling device.

In a simple and effective construction according to the invention, the second driven element may drive a transverse drive chain comprising a plurality of beads which are advantageously cylindrically shaped and have a total axial length which is greater than half the total axial length of the bead chain. This ensures a certain stiffness of operation and can assist in the amount of torque being required to disengaged the coupling device not exceeding the torque required for driving the second driven element.

In order that the present invention may more readily be understood, the following description is given, merely by way of example, reference being made to the accompanying drawings in which:

FIG. 1 is a perspective view of one embodiment of vertical blind with an operating mechanism of the present invention;

Figures 2A, 2B:
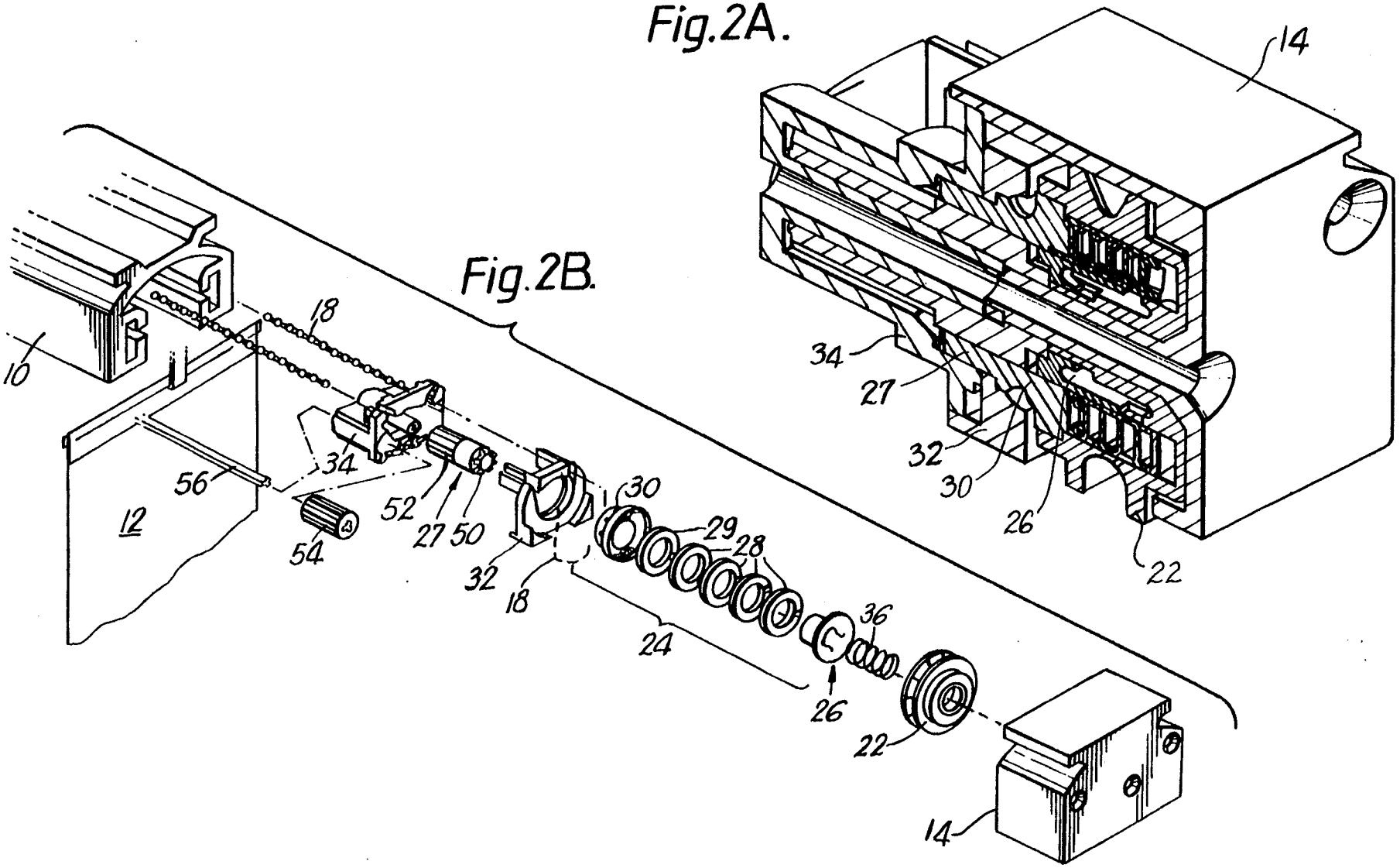
FIG. 2A is an isometric section taken through one embodiment of the operating mechanism of the invention.
FIG. 2B is an exploded isometric view of the mechanism shown in FIG. 2A further showing a part of a window covering in which the mechanism is mounted.
Figure 3A:
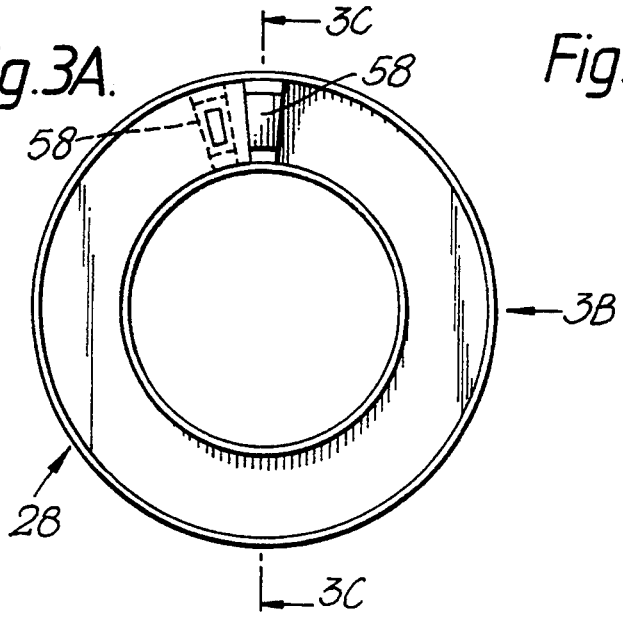
Figure 3C:
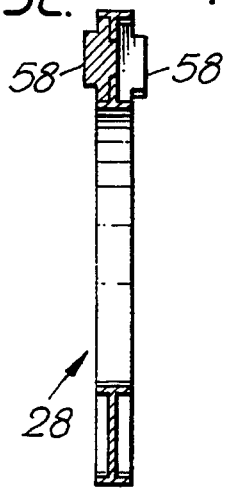
Figure 3B:
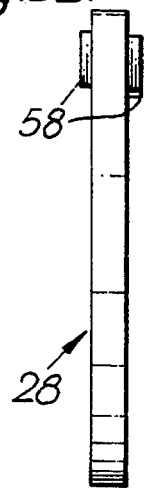
Figure 4:
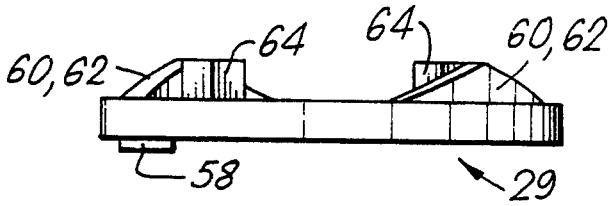
Figure 5:
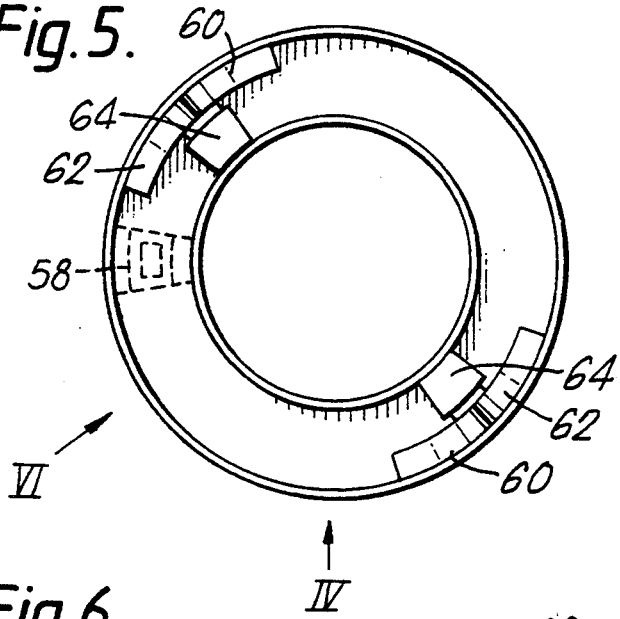
Figure 6:
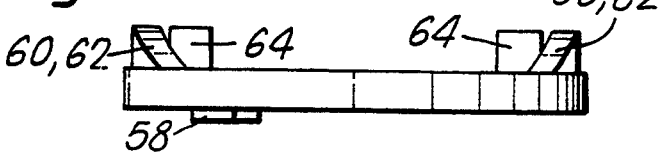

FIGS. 3*a*, 3*b* and 3*c* are an end elevation, a side elevation and a section on the line 3*c*—3*c* respectively, to an enlarged scale, of one of the discs forming part of the lost motion connection;

FIGS. 4, 5 and 6 are a side elevation viewed in the direction of arrow IV of FIG. 5, an end elevation and a further side elevation viewed in the direction of the arrow VI in FIG. 5, respectively of an end disc of the lost motion connection, to the same scale as FIGS. 3*a*, 3*b* and 3*c*;

FIG. 7 is a side elevation of the second driven element of the mechanism of FIG. 2;

FIG. 8 is a plan view of the second driven element of FIG. 7; and

FIG. 9 is a cross-section through the driving part 26 of the mechanism of FIG. 2.

Referring first to FIG. 1, there is illustrated therein a blind including a headrail 10 having depending therefrom, in a conventional way, a plurality of vertically extending slats or louvers 12. These slats or louvers, as is conventional, are capable of being rotated about their central vertical axis to provide a tilting motion and are capable of being moved to and from a retracted position either to one side or both sides of the headrail.

Mounted in the end of the headrail 10 is a mechanism 14 according to the invention, this being operated by a first operating bead chain 16. As will be explained later, the mechanism 14 is also capable of operating a second bead chain 18 formed from a plurality of elongate cylindrical plastic beads 20 for moving the slats to and from the retracted position. The total length of the beads of the second bead chain 18 together being greater than half the length of the whole bead chain thereby to increase the stiffness of the bead chain 18.

If reference is now made to FIG. 2, like parts are shown both in top assembled sectional view and the bottom exploded view and the parts which are the same are shown joined by chain dotted lines for simplicity. Rotatably mounted within the housing is a common actuating member 22 in the form of a normal bead chain type pulley, further details of which are shown in and will be described later.

A driving part 26 is adapted to be driven by the common actuating member 22 and itself cooperates, in a dog clutch type coupling to be described later, with a first driven element 27. Immediately adjacent the driving part 26 are stacked the parts of the lost motion mechanism 24 in the form of several lost motion discs 28,29 to be described later.

Associated with the last or left most of these discs 29 is a second driven element 30, the outer surface of which is in the form of a bead chain pulley adapted to engage a looped part of the second Dead chain 18.

Mounted adjacent the second driven element 30 is a housing guiding piece 32 which serves as a guide for the second bead chain 18 within the housing. An end insert or housing base 34 closes the housing and these assembled parts can readily be seen in the upper part of FIG. 2. It will be noted that there is additionally a coil compression spring 36 located between the common actuating member 22 and the driving part 26.

If reference is now made to FIG. 9 the driving part 26 can be seen to include a hub 38 having associated with the left-end thereof dog clutch members 40 and at the right-end of the hub 38 is a peripheral flange 42 having on the left face an annular groove 44 interrupted by an axial abutment 46. The interior of the hub 38 is dimensioned to accept the spring 36 and the right-hand end part of the hub is provided with keyways 48 adapted to engage keys (not shown) on the actuating member 22 to cause rotation thereof while allowing relative axial movement.

It will be seen that the first driven element 27 comprises further dog clutch members 50 releasibly engageable with the dog clutch members 40 associated with the hub 38 of the driving part 26 and the first driven element 27 is also provided with gear teeth 52 engageable with a gear wheel 54 which is used to drive a tilt rod 56. Gear wheel 54 and tilt rod 56 have been shown in the drawing entirely schematically and very much in a different position, they actually being located substantially adjacent the bead chain 18. The tilt rod is used to cooperate with a conventional mechanism for tilting, that is to say changing the angular position of the louvers or slats 12.

The discs 28 of the lost motion device are circular and essentially flat and provided on opposite faces with projections 58, the projection on one face being slightly angularly offset in comparison to the projection 58 on the opposite face, as can be seen in FIGS. 3*a*, 3*b* and 3*c*.

If reference is now made to FIGS. 4, 5 and 6, it can be seen that the end disc 29 is also essentially flat and provided on one face with an abutment projection 58. On the opposite face (facing the second driven element 30) ramp 60,62 replace the other projection 58 of the discs 28. The ramp 60,62 provide inclined faces and a positive stop 64 which is located centrally off of the upper parts of the ramps 60,62, but radially inwardly thereof to provide a compact structure of said end disc.

If reference is now made to FIGS. 7 and 8, the second driven element 30 is shown therein and includes a pulley portion 66 for the second bead chain 18, and facing the end disc 29 of the lost motion discs, ramps 68 and 70, a corresponding positive stop 72.

In operation, the first bead chain 16 is pulled causing the actuating member 22 to rotate. This will cause, via the keyways 48 and the corresponding keys on the member 22, the driving part 26 to rotate. The dog clutch thereon, through spring 36, will be engaged with the dog clutch portion of the first driven element 27 causing that to rotate which in turn will cause the gear wheel 54 and tilt drive shaft 56 to rotate thereby tilting the slats 12.

Simultaneously the first or right-hand most disc 28 will eventually be caused to rotate by the axial abutment 46 of the driven part 26 engaging the projection 58 and as soon as its opposite projection engages with the corresponding projection 58 of the next disc, that disc will rotate by a similar amount and so on. A lost motion connection will thereby be given whereby approximately five or six turns of the driven member 26 are allowed to take place. The friction encountered by the second driven element 30 initially will keep this element stationary during the engagement of the ramps 60,62 of the last disc 29 with the ramps 68,70 of the second driven element 30. This friction is at least to a certain extent produced by the stiffness of the second bead chain 18.

As a result of further ,relative movement between the ramps 60,62 of the last disc 29 and those of the element 30, the lost motion discs 28,29 and the peripheral flange 42 and the driving part 26 with it are forced apart until the positive stops 64,72 engage one another and transmit relative movement to the second driven element 30.

While the last disc is actually forced away from the second driven element 30, it pushes through the preceding discs 28, the driving part 26 inwardly of the common actuating member 22 against the action of the compression spring 36. Since the first lost motion disc in the form of peripheral flange 42 is integral with the driving part 26 forming the first member of the dog clutch coupling device and is rotationally coupled to the actuating member 22 by keyways 48, this action declutches the dog clutch on the driving part 26 and the first driven element 27 which thereby stops rotation of the tilt rod 56.

At the same time the driven element 30 through positive stops 64 and 72 has just begun to rotate and, the second bead chain 18 is operated to pull a carriage (not shown) in one direction or the other, this carriage being the master carriage is linked to the other carriages for holding the louvers or slats 12 in a known manner.

It is to be emphasized that the confronting faces of the discs 28 and second driven element 30 need not be identical as illustrated. As an alternative, one face could be provided with a cam, which rides on a ramp provided only on a single one of the confronting faces. Similarly the positive stop could be integrally formed with the ramp. However, by having the positive stops and the ramps separately located as illustrated in the drawings, this will reduce the axial volume of the lost motion mechanism, which is important to reduce the total volume so that an adequate number of discs 28, 29 can be accommodated within as small a space as possible.

We claim:

1. An operating mechanism for a blind or shielding device having angularly adjustable and retractable slats, said mechanism compressing a first driven element for pivotally adjusting the angular orientation of the slats, a second driven element for transversely moving the slats towards and away from a retracted position, a common actuating member for sequentially driving said first and second driven elements, a coupling device directly engaging said first driven element to said common actuating member, a final engagement and a lost motion mechanism for releasibly coupling said common actuating member to said second driven element and allowing entraining of said second driven element after a predetermined number of revolutions of said actuating member in either of two different rotational senses, the final engagement associated with said lost motion mechanism in each rotational sense inducing a reactive force in a direction perpendicular to a longitudinal axis thereof, said reactive force assisting in declutching of said coupling device, wherein the lost motion mechanism comprises a plurality of discs each having a first projection extending from one axial face thereof and a second projection extending from the opposite axial face thereof, said projections being adapted to entrain a next adjacent disc after a predetermined amount of rotation between said adjacent discs, and wherein the final engagement of the lost motion mechanism comprises an inclined surface on at least one of said discs, inducing the reactive force in the axial direction of said coupling device and allowing said movement by an amount sufficient to declutch the coupling device.

2. A mechanism, for a blind or shielding device having angularly adjustable and retractable slats, said mechanism comprising a first driven element for pivotally adjusting the angular orientation of the slats and a second driven element for traversely moving the slats towards and away from a retracted position, a common actuating member for sequentially driving said first and second driven elements, a coupling device directly engaging said first driven element to said common actuating member, a final engagement and lost motion mechanism for releasibly coupling said common actuating member to said second driven element and allowing entraining of said second driven element after a predetermined amount of rotation of said actuating member in either of two different rotational senses, a final engagement associated with said lost motion mechanism in each rotational sense inducing a reactive force in a direction parallel to a longitudinal axis of the mechanism, said reactive force assisting in declutching of said coupling device, wherein the lost motion mechanism comprises a plurality of discs each having a first projection extending from one axial face thereof and a second projection extending from the opposite axial face thereof, said projections being adapted to entrain a next adjacent disc after a predetermined amount of rotation between said adjacent discs.

3. An operating mechanism for a blind or shielding device having adjustable and retractable slats (12), said mechanism comprising:

a first driven element for pivotally adjusting the slats about their longitudinal axes;

a second driven element for moving the slats towards and away from a retracted position;

a common actuating member for sequentially driving said first and second driven elements;

a disengagable drive clutch interposed between said common actuating member and said first driven element for transmitting a motive force from said actuating element to said first driven element;

a lost motion mechanism interposed between said common drive member and said second driven element for drivingly connecting said actuating meter to said second driven element after a predetermined number of revolutions of said actuating member in either of two opposite rotational senses; and clutch actuating means for disengaging said drive clutch upon said lost motion mechanism reaching final engagement in each of said two opposite rotational senses, wherein said drive clutch and said lost motion mechanism share a common axis of rotation and wherein said clutch actuating means utilizes a reactive force induced in the longitudinal direction of said common axis of rotation and effective to separate individual members of said clutch.

4. A mechanism according to claim 3, wherein transmission of power from the actuating member to the first driven element is by means of said drive clutch having axially engaging and disengaging mating members.

5. A mechanism according to claim 3, wherein torque required to disengage the drive clutch does not exceed the torque required for driving second driven element.

6. A mechanism according to claim 3 wherein the lost motion mechanism comprises a plurality of discs each having a first projection extending from one axial face thereof and a second projection extending from the opposite axial face thereof, said projections being adapted to entrain a next adjacent disc after a predetermined amount of rotation between said adjacent discs.

7. A mechanism according to claim 3, wherein the drive clutch is biased towards axial engagement by means by a compression spring.

8. A mechanism according to claim 3 wherein said drive clutch, and is driveably and axially slidably engaged on said actuating member by means of cooperating keys and keyways on said actuating member and said drive clutch.

9. A mechanism according to claim 3, further comprising a transverse drive chain wherein said second driven element drives said transverse drive chain comprising a plurality of beads.

10. A mechanism according to claim 3, further comprising a bead chain, wherein said actuating member is driven by said bead chain.

11. An operating mechanism for a blind or shield device according to claim 3 further comprising angularly adjustable and relatively retractable slats.

12. An operating mechanism for a blind or shielding device having angularly adjustable and retractable slats, said mechanism comprising a first driven element for pivotally adjusting the angular orientation of the slats and a second driven element for traversingly moving the slats towards and away from a retracted position, a common actuating member for sequentially driving said first and second driven elements, an axially engaging and disengaging clutch device directly connecting said first driven element to said common actuating member, lost motion mechanism for engaging said second driven element by said common actuating member and allowing transmission of a motive force to said second driven element after a predetermined number of revolutions of said actuating member in either of two different rotational senses, final engagement of said lost motion mechanism in each rotational sense inducing a reactive force assisting in a declutching of said clutch device, wherein the lost motion mechanism comprises a plurality of discs each having a first projection extending from one axial face thereof and a second projection extending from the opposite axial face thereof, said projections being adapted to entrain a next adjacent disc after a predetermined amount of rotation between said adjacent discs, and wherein the final engagement of the lost motion mechanisms comprises an inclined ramp surface on at least one of said discs, inducing the reactive force in the axial direction of said clutch device and allowing axial movement of said clutch device by an amount sufficient to declutch said clutch device.

13. A mechanism according to claim 12, further comprising a positive stop wherein rotational displacement permitted between the final engagement of the lost motion mechanism and the second driven element upon engagement of said inclined surface is restricted by said positive stop.

14. A mechanism according to claim 13, wherein the positive stop is at a different radial location of the final disc from the inclined surface thereof.

15. An operating mechanism for a blind or shielding device having angularly adjustable and retractable slats, said mechanism comprising a first driven element for pivotally adjusting the angular orientation of the slats and a second driven element for traversingly moving the slats towards and away from a retracted position, a common actuating member for sequentially driving said first and second driven elements, an axially engaging and disengaging clutch device operatively connecting said first driven element to said common actuating member, a lost motion mechanism for operatively engaging said second driven element with said common actuating member and allowing transmission of a motive force to said second driven element after a predetermined amount of rotation of said actuating member in either of two different rotational senses, and disengaging means for physically and operatively disengaging said first driven element from said common actuating member through said clutch device, final engagement of said lost motion mechanism in at least one rotational sense inducing a reactive force assisting in said physical disengagement of the first driven element from said common actuating member and wherein said second driven element drives a traverse drive chain for traversing said slats to and from a retracted position, said drive chain comprising a plurality of cylindrically shaped beads.

16. A mechanism according to claim 15 wherein the total axial length of all of the beads of the bead chain is greater than half of the total axial length of the bead chain.

17. An operating mechanism for a blind or shielding device having adjustable and retractable louvres, said mechanism comprising a first driven element for adjusting the orientation of the louvres, a second driven element for moving the louvres towards and away from a retracted position, a common actuating member for sequentially driving said first and second driven elements, a disengageable drive clutch interposed between said common actuating member and said first driven element for transmitting a motive force from said actuating element to said first driven element, said drive clutch comprising first and second clutch members biased towards engagement with one another, a lost motion mechanism interposed between said common drive member and said second driven element for drivingly connecting said common actuating member to said second driven element after a predetermined amount of rotation of said actuating member in either of two opposite rotational senses, and disengaging means for disengaging said drive clutch upon said lost motion mechanism reaching final engagement in each of said two opposite rotational senses, wherein said clutch disengaging means utilizes a reactive force induced at the time of final engagement of said lost motion mechanism to reduce the bias on said first and second clutch members thereby physically separating said common actuating member from said first driven element.

18. A mechanism according to claim 17, wherein the lost motion mechanism comprises a plurality of discs each having a first projection extending from one axial face thereof and a second projection extending from the opposite axial face thereof, said projections being adapted to entrain a next adjacent disc after a predetermined amount of rotation between said adjacent discs.

19. A mechanism according to claim 17, wherein said second driven element drives a flexible drive element for traversely moving said slats.

* * * * *

UNITED STATES PATENT AND TRADEMARK OFFICE

CERTIFICATE OF CORRECTION

PATENT NO. : 5,390,721

DATED : February 21, 1995

INVENTOR(S) : Herman Oskam and Dirk A. Ploeg

It is certified that error appears in the above-indentified patent and that said Letters Patent is hereby corrected as shown below:

On the title page:

| | |
|---|---|
| Item [73] | "Willemstad, Netherlands" should read --Willemstad, Netherlands Antilles--. |
| Col. 3, line 19 | "Dead" should be --bead--. |
| Col. 4, line 27 | "further,relative movement" should be --further relative movement--. |
| Col. 6, line 4 | "meter" should be --member--. |
| Col. 6, line 35 | "drive clutch, and is driveably" should read --drive clutch is driveably--. |
| Col. 7, line 6 | "mechanisms comprises" should be --mechanism comprises--. |

Signed and Sealed this

First Day of April, 1997

Bruce Lehman

BRUCE LEHMAN

*Commissioner of Patents and Trademarks*

*Attest:*

*Attesting Officer*